US011859836B2

(12) United States Patent
Yang et al.

(10) Patent No.: US 11,859,836 B2
(45) Date of Patent: Jan. 2, 2024

(54) WALL-MOUNTED AIR PURIFIER

(71) Applicant: SHENZHEN ANTOP TECHNOLOGY CO., LTD, Shenzhen (CN)

(72) Inventors: Boliang Yang, Shenzhen (CN); Ruidian Yang, Shenzhen (CN); Chu Yan, Shenzhen (CN)

(73) Assignee: SHENZHEN ANTOP TECHNOLOGY CO., LTD, Shenzhen (CN)

( * ) Notice: Subject to any disclaimer, the term of this patent is extended or adjusted under 35 U.S.C. 154(b) by 451 days.

(21) Appl. No.: 17/216,731

(22) Filed: Mar. 30, 2021

(65) Prior Publication Data

US 2022/0252279 A1 Aug. 11, 2022

(30) Foreign Application Priority Data

Feb. 7, 2021 (CN) ..... 202120349524.7

(51) Int. Cl.

| | |
|---|---|
| ***F24F 1/00*** | (2019.01) |
| ***F24F 1/0057*** | (2019.01) |
| ***F24F 8/10*** | (2021.01) |
| ***F24F 11/30*** | (2018.01) |
| ***F24F 8/22*** | (2021.01) |
| *F24F 140/00* | (2018.01) |

(52) U.S. Cl.

CPC ..... *F24F 1/0057* (2019.02); *F24F 8/10* (2021.01); *F24F 8/22* (2021.01); *F24F 11/30* (2018.01); *F24F 2140/00* (2018.01); *F24F 2221/17* (2013.01)

(58) Field of Classification Search

CPC .... F24F 1/0057; F24F 8/10; F24F 8/22; F24F 11/30; F24F 2140/00; F24F 2221/17

See application file for complete search history.

(56) References Cited

U.S. PATENT DOCUMENTS 3,626,668 A * 12/1971 Cardiff ..... B03C 3/155 55/318
5,035,728 A * 7/1991 Fang ..... B03C 3/68 422/120
5,575,326 A * 11/1996 Asami ..... F24F 1/0323 165/122

(Continued)

FOREIGN PATENT DOCUMENTS

EP 2299190 A2 * 3/2011 ..... F24F 1/0007

*Primary Examiner* — Stephen Hobson

(74) *Attorney, Agent, or Firm* — CANTOR COLBURN LLP

(57) ABSTRACT

The present application provides a wall-mounted air purifier, which includes a casing, a fan and a purification module; the casing is provided with an air inlet and an air outlet; the fan is located between the air inlet and the air outlet; and the purification module is arranged at an air flow path of the fan; the purification module comprises a bracket mounted in the casing and a filter inserted in the bracket, a front side surface of the casing is provided with a insertion hole configured for inserting the filter into the bracket, the insertion hole is located at a position corresponding to the filter, the wall-mounted air purifier further comprises a front cover covering at a front side of the casing, and the front cover is detachably connected to the casing.

13 Claims, 13 Drawing Sheets

(56) References Cited

U.S. PATENT DOCUMENTS 5,755,103 A * 5/1998 Na ..... F24F 1/0076 62/264
5,980,600 A * 11/1999 Stopyra ..... F24F 13/28 55/497
5,987,911 A * 11/1999 Arai ..... F24F 1/0057 62/229
6,685,760 B2 * 2/2004 Huehn ..... F24F 8/158 55/486
2005/0284170 A1 * 12/2005 Lee ..... F24F 1/0014 62/428
2006/0213157 A1 * 9/2006 Kalous ..... F24F 8/158 55/385.2
2007/0209373 A1 * 9/2007 Taira ..... F24F 1/0063 62/78
2009/0188223 A1 * 7/2009 Pippel ..... B01D 46/0005 55/503
2010/0186357 A1 * 7/2010 Takeda ..... F24F 8/10 55/471
2010/0287966 A1 * 11/2010 Cha ..... F24F 1/0063 62/263
2011/0000251 A1 * 1/2011 Oka ..... F24F 1/0057 62/404
2011/0033346 A1 * 2/2011 Bohlen ..... F24F 8/80 422/186.3
2011/0048050 A1 * 3/2011 Moteki ..... F24F 1/0059 62/263
2011/0314855 A1 * 12/2011 Yu ..... F24F 1/0057 62/222
2012/0171948 A1 * 7/2012 Yamazaki ..... F24F 1/0057 454/313
2015/0306533 A1 * 10/2015 Matlin ..... F24F 8/158 96/417
2017/0138613 A1 * 5/2017 Bai ..... F24F 1/0047
2018/0017284 A1 * 1/2018 Oishi ..... B01D 46/4227
2018/0021468 A1 * 1/2018 Kim ..... F24F 1/0047 250/436
2018/0021469 A1 * 1/2018 Kim ..... F24F 1/0073 454/233
2018/0023820 A1 * 1/2018 Kim ..... F24F 13/30 250/435
2018/0023821 A1 * 1/2018 Kim ..... F24F 13/222 62/264
2018/0100667 A1 * 4/2018 Komae ..... F24F 8/80
2019/0001249 A1 * 1/2019 Hong ..... F24F 8/80
2019/0226696 A1 * 7/2019 Kim ..... F24F 6/04
2019/0226698 A1 * 7/2019 Kim ..... F24F 13/20
2019/0232210 A1 * 8/2019 Hur ..... B01D 46/442
2020/0182495 A1 * 6/2020 Park ..... F24F 8/10
2020/0200429 A1 * 6/2020 Qin ..... F24F 13/20

* cited by examiner

WALL-MOUNTED AIR PURIFIER

CROSS-REFERENCE TO RELATED APPLICATIONS

The present application claims the priority of CN application 202120349524.7, filed on Feb. 7, 2021, the whole content of which is incorporated herein by reference.

FIELD

The present application relates to the technical filed of air purification, and more particularly to a wall-mounted air purifier.

BACKGROUND

As people pay more attention to the environment, the use of air purifiers is increasing. The current air purifiers are divided into floor-standing and wall-mounted. The wall-mounted air purifiers are generally mounted on the wall and will not occupy the floor space of the room, and are more and more favored by users. In the current related technology, a filter is generally mounted in the casing to filter the air to achieve air purification. In order to facilitate the replacement of the filter, an opening window is generally provided on the casing to replace the filter from the opening window, and a reversible cover is provided to cover the opening window, but this structure will affect the appearance of the air purifier.

SUMMARY

An object of the present application is to provide a wall-mounted air purifier, in order to solve the problem that the appearance of wall-mounted air purifiers and the convenience of filter replacement in the prior art are difficult to balance.

In order to achieve the above object, the present application adopts the technical solution is to provide a wall-mounted air purifier, which includes a casing provided with an air inlet and an air outlet; a fan mounted in the casing and located between the air inlet and the air outlet; and a purification module mounted in the casing and arranged at an air flow path of the fan; the purification module includes a bracket mounted in the casing and a filter inserted in the bracket, a front side surface of the casing is provided with a insertion hole configured for inserting the filter into the bracket, the insertion hole is located at a position corresponding to the filter, the wall-mounted air purifier further includes a front cover covering at a front side of the casing, and the front cover is detachably connected to the casing.

In an optional embodiment, the casing is mounted with a sensor configured for sensing the front cover.

In an optional embodiment, the sensor is mounted inside the casing, and the casing is provided with an opening configured for exposing the sensor.

In an optional embodiment, the bracket respectively includes a support plate arranged at two sides of the filter, and each support plate is provided with a slot configured for an end portion of the filter inserting therein.

In an optional embodiment, the purification module further includes an ultraviolet light source disposed between the two support plates.

In an optional embodiment, the bracket further includes enclosing plate cooperated with the two support plates to form a box structure, and the enclosing plate being arranged around the ultraviolet light source, wherein a side of the enclosing plate adjacent to the air inlet is provided with an air inlet hole, and a side of the enclosing plate adjacent to the fan is provided with an air outlet hole.

In an optional embodiment, a side of the enclosing plate adjacent to the air inlet hole is provided with the filter, and/or a side of the enclosing plate adjacent to the air outlet hole is provided with the filter.

In an optional embodiment, the purification module further includes a detector for sensing the filter, and the detector being mounted on the bracket.

In an optional embodiment, the casing includes a top cover provided with the air inlet, and a height of a sidewall of the air inlet is greater than a height of another sidewall of the air inlet.

In an optional embodiment, a sidewall of the air inlet adjacent to a front side of the casing extends downwardly from a front to back direction.

The beneficial effects of the wall-mounted air purifier provided by the embodiments of the present application are: compared with the prior art, the wall-mounted air purifier of the present application is provided with the bracket in the casing, and the filter is inserted on the bracket, and the front side of the casing is provided with the insertion hole to realize the removing and replacement of the filter, and the replacement of the filter is convenient; further, with the front cover being detachably covered at the front side of the casing to protect the filter and improve the appearance of the casing, so as to balance the appearance of the wall-mounted air purifier and the convenience of filter replacement.

DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

Figure 1:
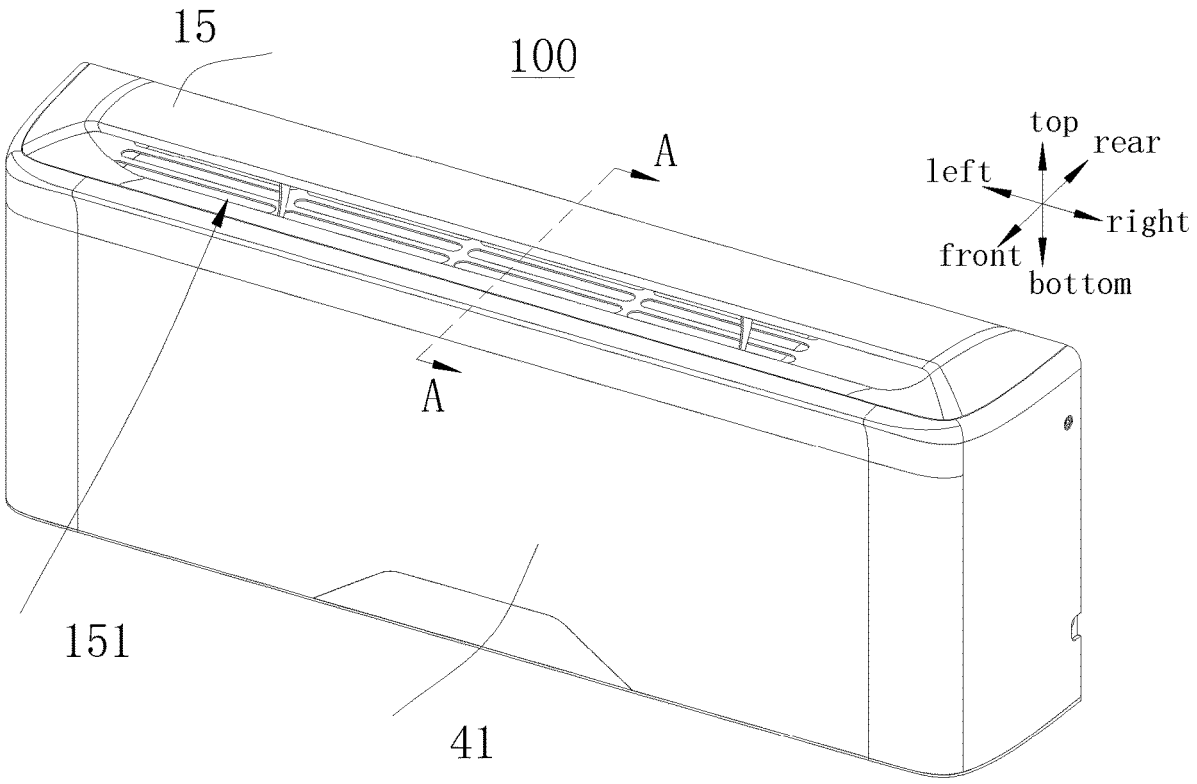
FIG. 1 is a schematic perspective view of a wall-mounted air purifier provided by an embodiment of the present application.

100—wall-mounted air purifier;

10—casing; 11—front side plate; 111—insertion hole; 112—opening; 113—engagement opening; 12—side plate; 13—back plate; 131—inclined plate; 132—extending plate; 133—support plate; 1331—through hole; 134—hook; 135—partition; 136—hanging buckle; 14—bottom plate; 141—air outlet; 142—stop baffle; 15—top cover; 151—air inlet; 154—reinforcing plate;

20—purification module; 21—bracket; 211—support plate; 2111—slot; 212—enclosing plate; 2121—air inlet hole; 2122—air outlet hole; 2123—opening; 22—filter; 23—ultraviolet light source; 24—detector;

30—fan; 31—cross flow wind wheel; 32—support seat; 33—motor;

41—front cover; 411—hanging hook; 42—sensor; 43—cover; 431—deflector; 432—bending plate; 4321—vertical plate; 4322—upper side plate; 430—cable channel; 4301—sub-channel; 44—hanging plate; 441—hook body;

50—wind guide assembly; 51—wind guide piece; 511—through opening; 52—rotating shaft; 53—motor.

DETAILED DESCRIPTION

In order to make the technical problem to be solved, the technical solution and the advantages of the present application be clearer and more understandable, the present application will be further described in detail below with reference to accompanying figures and embodiments. It should be understood that the specific embodiments described herein are merely intended to illustrate but not to limit the present application.

It is noted that when a component is referred to as being "fixed to" or "disposed on" another component, it can be directly or indirectly on another component. When a component is referred to as being "connected to" another component, it can be directly or indirectly connected to another component.

In addition, terms "the first" and "the second" are only used in describe purposes, and should not be considered as indicating or implying any relative importance, or impliedly indicating the number of indicated technical features. As such, technical feature(s) restricted by "the first" or "the second" can explicitly or impliedly comprise one or more such technical feature(s), in the description of the present application, "a plurality of" means two or more, unless there is additional explicit and specific limitation.

In the description of the present application, it needs to be understood that, directions or location relationships indicated by terms such as "length", "width", "up", "down", "front", "rear", "left", "right", "vertical", "horizontal", "top", "bottom", "inside", "outside", and so on are the directions or location relationships shown in the accompanying figures, which are only intended to describe the present application conveniently and simplify the description, but not to indicate or imply that an indicated device or component must have specific locations or be constructed and manipulated according to specific locations; therefore, these terms shouldn't be considered as any limitation to the present application.

In the description of the present application, it is noted that unless there is additional explicit stipulation and limitation, terms such as "mount", "connect with each other", "connect", "fix", and so on should be generalizedly interpreted, for example, "connect" can be interpreted as being fixedly connected, detachably connected, or connected integrally; "connect" can also be interpreted as being mechanically connected or electrically connected; "connect" can be further interpreted as being directly connected or indirectly connected through intermediary, or being internal communication between two components or an interaction relationship between the two components. For the one of ordinary skill in the art, the specific meanings of the aforementioned terms in the present application can be interpreted according to specific conditions.

In the description of the present application, "one embodiment", "some embodiments" or "embodiments" described in the specification of the present application means that one or more embodiments of the present application include a specific feature, structure, or characteristic described in conjunction with the embodiment. Therefore, the phrases "in one embodiment", "in some embodiments", "in some other embodiments", "in some further embodiments", etc. appearing in different places in the specification are not necessarily all refer to the same embodiment, but mean "one or more but not all embodiments" unless otherwise specifically emphasized in other ways. In addition, in one or more embodiments, specific features, structures, or characteristics may be combined in any suitable manner.

Figure 2:
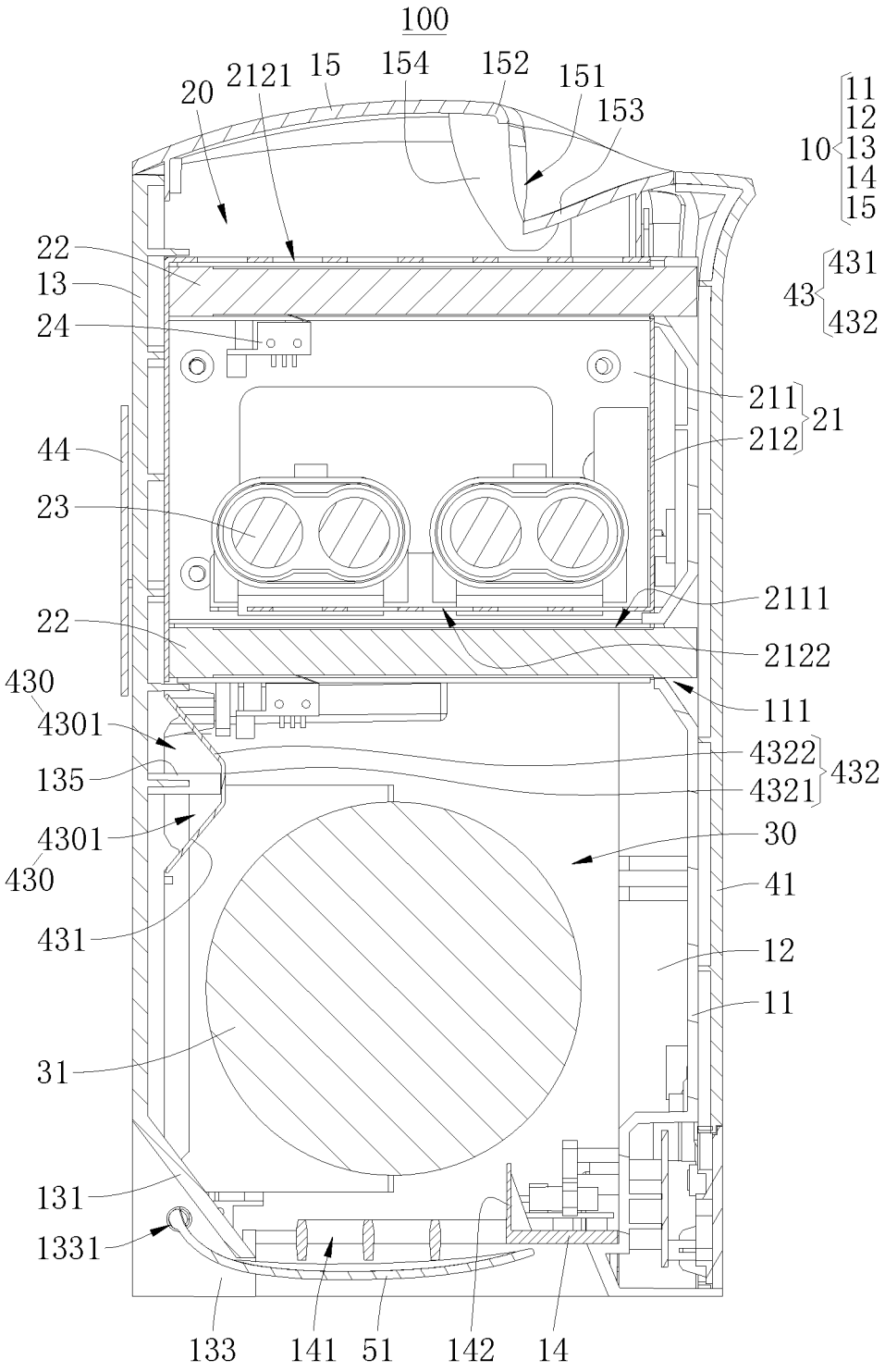
FIG. 2 is a schematic cross section view along line A-A of FIG. 1.
Figure 3:
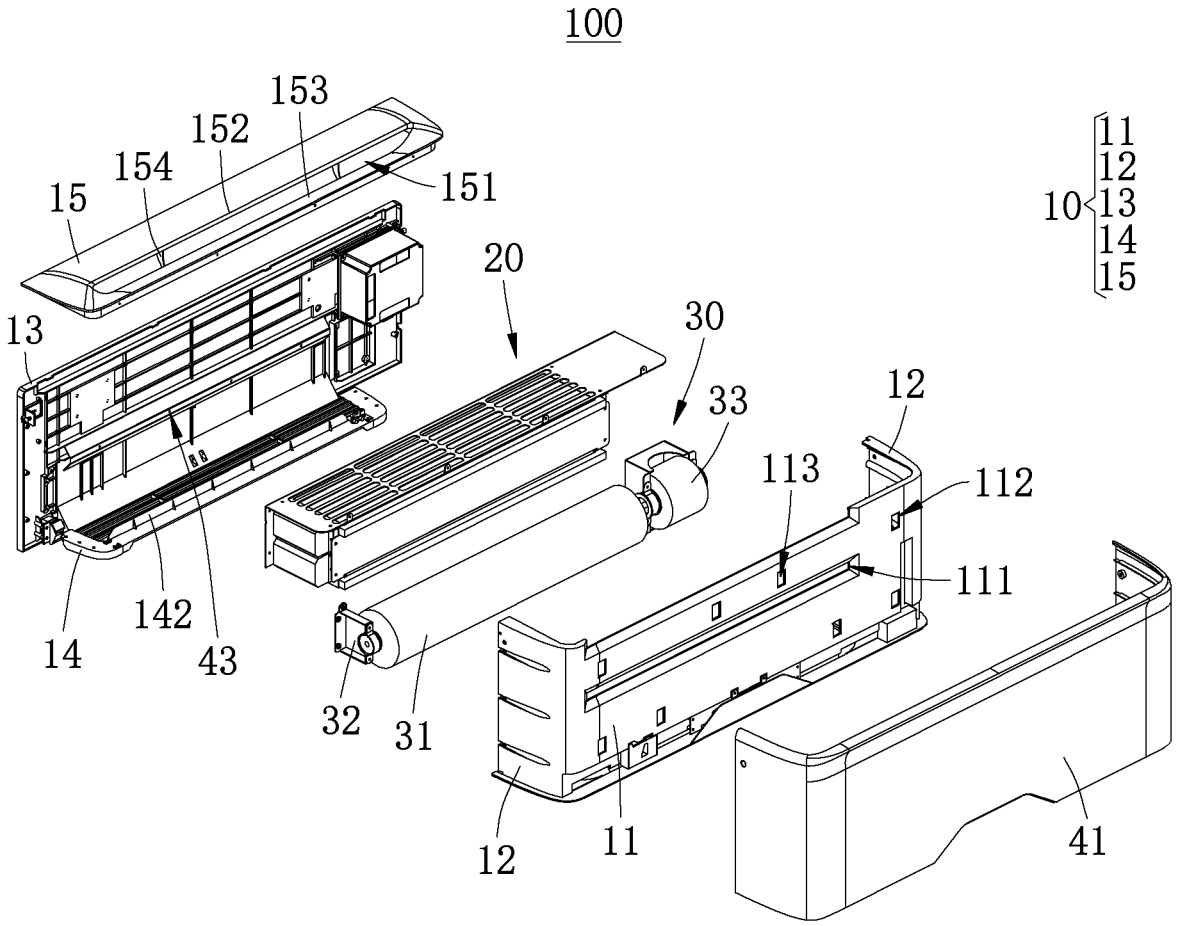
FIG. 3 is a schematic explosion view of a wall-mounted air purifier provided by an embodiment of the present application.

For the convenience of description, please refer to FIGS. 1 to 3, which is defined in the present application: when a casing is mounted on a wall, a side on the casing adjacent to the wall is a rear side of the casing and the wall-mounted air purifier, and a side on the casing away from the wall is the front side of the casing and the wall-mounted air purifier.

Please refer to FIGS. 1 to 3, the wall-mounted air purifier 100 provided in the present application will now be described. The wall-mounted air purifier 100 includes a casing 10, a purification module 20 and a fan 30. The purification module 20 and the fan 30 are mounted in the casing 10, and the purification module 20 and the fan 30 are protected by the casing 10. The casing 10 is provided with air inlet 151 and air outlet 141. The fan 30 is located between air inlet 151 and air outlet 141. When fan 30 is operating, air enters the casing 10 from the air inlet 151, and after being accelerated by the fan 30, the air flows out from air outlet 141. The purification module 20 is set on an air flow path of the fan 30, so that the air will pass through the purification module 20 during the process from the air inlet 151 to the air outlet 141, so that the purification module 20 can purify the air.

Figure 4:
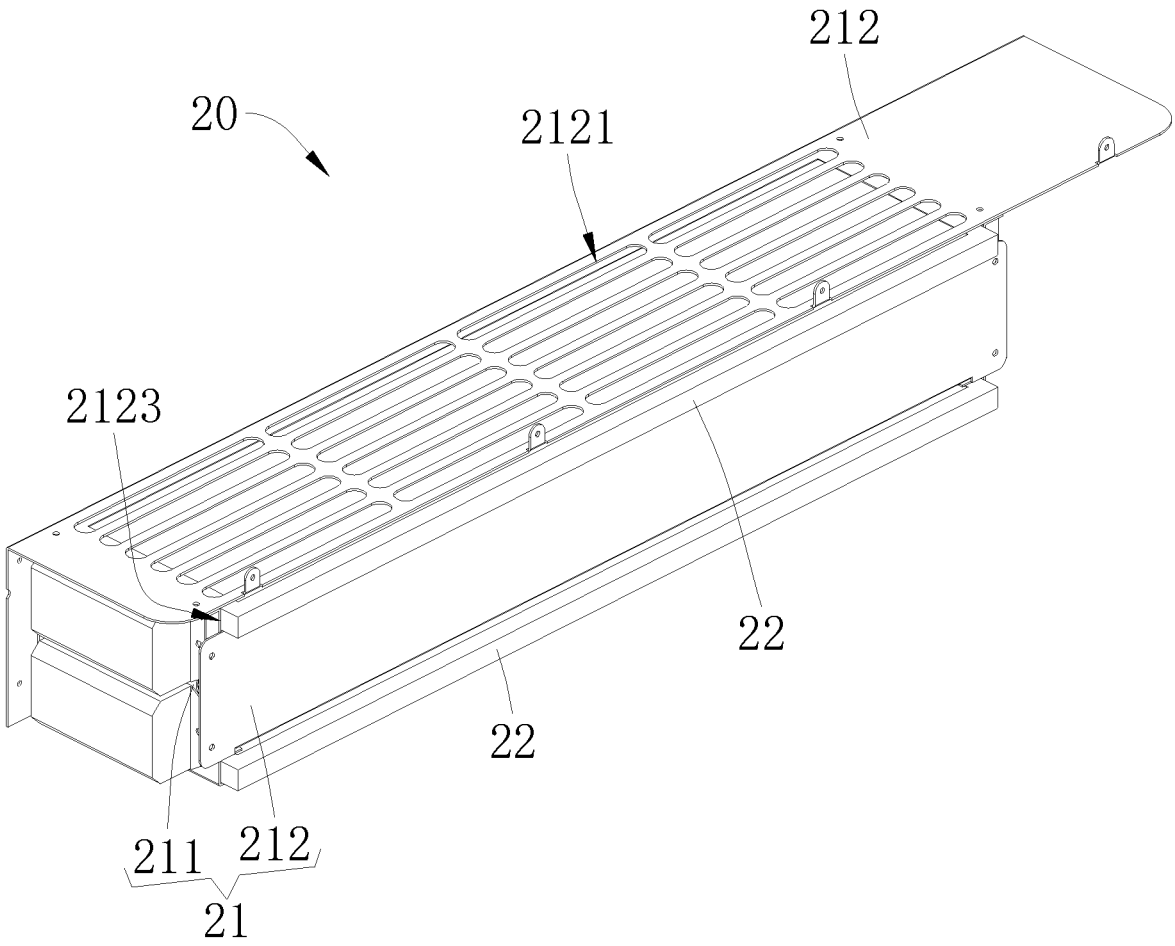
FIG. 4 is a structural schematic view of a purification module in the wall-mounted air purifier shown in FIG. 3.

In one embodiment, please refer to FIGS. 2 to 4. The purification module 20 includes a bracket 21 and a filter 22. The filter 22 is mounted on the bracket 21 to support the filter 22 via the bracket 21, and the bracket 21 is mounted in the casing 10 to support the filter 22 in the casing 10 to filter and remove dust via the filter 22. In some other embodiments, the purification module 20 may also be a high-voltage electrostatic module, which removes dust via high-voltage electrostatic.

In one embodiment, the filter 22 is inserted into the bracket 21 so that the filter 22 in the bracket 21 can be plugged and replaced, which is also convenient for the assembly of the purification module 20.

Figure 5:
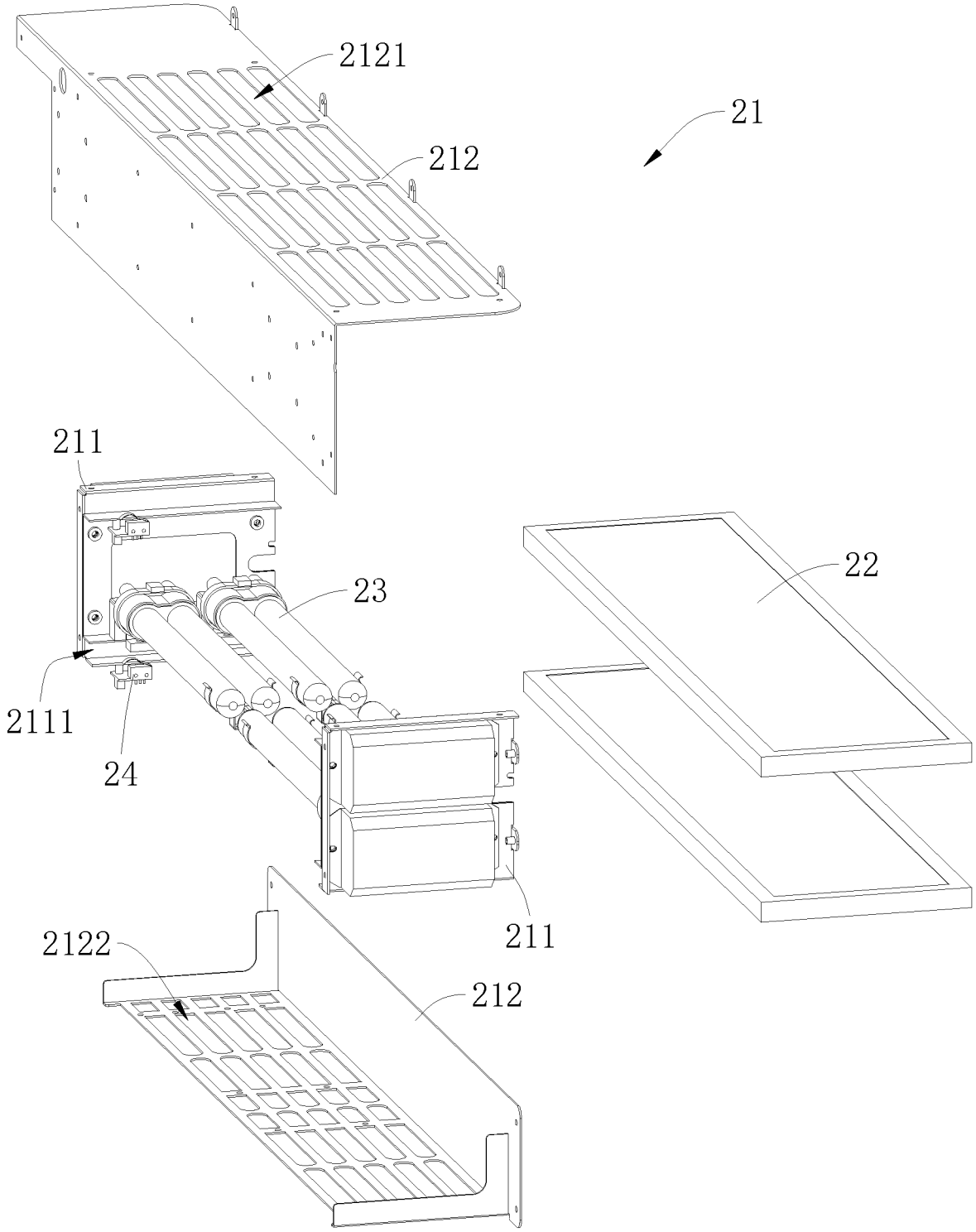
FIG. 5 is a schematic explosion view of the purification module shown in FIG. 4.

In one embodiment, referring to FIGS. 2, 4, and 5, the bracket 21 includes two support plates 211, and each support plate 211 is provided with a slot 2111, and the two support plates 211 are respectively provided at both ends of the filter 22. The slots 2111 on the two support plates 211 cooperate to support the two ends of the filter 22, that is, during assembling of the structure, the two ends of the filter 22 can be inserted into the slots 2111 of the two support plates 211 to facilitate assembly. The support plates 211 are mounted on the casing 10 to support the filter 22 on the casing 10. In addition, the support plates 211 can better position the filter 22 to facilitate the insertion of the filter 22. Of course, in other embodiments, the bracket 21 may also use other structures, such as using a rod structure to support the filter 22.

In one embodiment, referring to FIGS. 2, 4 and 5, the purification module 20 also includes an ultraviolet light source 23. The ultraviolet light source 23 is arranged between the two support plates 211 and can be supported by the two support plates 211. The arrangement of the ultraviolet light source 23 is convenient for sterilizing the air.

In one embodiment, referring to FIGS. 2, 4 and 5, the bracket 21 further includes an enclosing plate 212, which cooperates with two support plates 211 to form a box structure, and the enclosing plate 212 is arranged around the ultraviolet light source 23. An air inlet hole 2121 is provided on the side of the enclosing plate 212 adjacent to the air inlet 151, and an air outlet hole 2122 is provided on the side of the enclosing plate 212 adjacent to the fan 30, so that air can enter the enclosing plate 212 from the air inlet hole 2121 for sterilizing the air via the ultraviolet light source 23, and then the air flows out through the air outlet hole 2122. The arrangement of the enclosing plate 212 can protect the ultraviolet light source 23, and also prevent the ultraviolet light source 23 from emitting light to protect the casing 10.

In one embodiment, a filter 22 is provided on the side of the enclosing plate 212 adjacent to the air inlet hole 2121 to filter the air entering the enclosing plate 212, and the light can be blocked by the filter 22 to prevent the light from the ultraviolet light source 23 from being emitted from air inlet 151.

In one embodiment, a slot 2111 is provided on the support plate 211 adjacent to the air inlet hole 2121, and the slot 2111 is located in the enclosing plate 212, and an opening 2123 is provided on the enclosing plate 212 on the side adjacent to the air inlet hole 2121, so that the filter 22 is inserted into the slot 2111 of the support plate 211 via the opening 2123. This structure can protect the filter 22 through the enclosing plate 212 adjacent to the air inlet 151. Of course, in one embodiment, the slot 2111 can also be provided on the outside of the enclosing plate 212.

In one embodiment, the filter 22 is provided on the side of the enclosing plate 212 adjacent to the air outlet hole 2122, so that the air flowing out of the enclosing plate 212 can be filtered. In one embodiment, the slot 2111 is provided on the support plate 211 adjacent to the air outlet hole 2122, and the slot 2111 is located outside the enclosing plate 212. Of course, in some other embodiments, the slot 2111 on the support plate 211 adjacent to the air outlet hole 2122 can also be provided in the enclosing plate 212, and the opening 2123 is provided on the enclosing plate 212 corresponding to the enclosing plate 212, so that the filter 22 can be inserted and removed.

In one embodiment, the purification module 20 further includes a detector 24, the detector 24 is mounted on the bracket 21, the detector 24 is configured for sensing the filter 22, and the detector 24 is mounted on the bracket 21 to determine whether the filter 22 is inserted in the bracket 21, so as to ensure that the purification module 20 can filter and purify the air well. In one embodiment, the detector 24 may be a micro switch. When the filter 22 is inserted in the bracket 21, the filter 22 touches the micro switch to activate the micro switch to sense whether the filter 22 is mounted in the bracket 21. Of course, in some other embodiments, the detector 24 may also be a photodetector or the like.

In one embodiment, the detector 24 may be mounted on the support plate 211 adjacent to the slot 2111, so as to sense whether the slot 2111 is inserted with the filter 22.

In one embodiment, the enclosing plate 212 adopts a combination of multiple plate structures to form the box structure with the support plates 211. In some other embodiments, the enclosing plate 212 may also use a cylindrical shell structure, and two support plates 211 are covered on both ends of the cylindrical shell to form the box structure.

In one embodiment, please refer to FIGS. 2 and 3, the air inlet 151 is located at the top of the casing 10, and the air outlet 141 is located at the bottom of the casing 10, so as to achieve good air circulation, and to discharge air from the bottom of the casing 10, which is convenient to blow the purified air to the bottom, so that the user can use it directly. In some other embodiments, the air inlet 151 may also be provided on the front side of the casing. In some embodiments, the air outlet 141 may be provided on the front side of the casing 10.

In one embodiment, referring to FIGS. 2 and 3, the casing 10 includes a top cover 15, a back plate 13, a bottom plate 14, a front side plate 11, and two side plates 12, and the two side plates 12 are located at left and right ends of the front side plate 11, the rear ends of the two side plates 12 are connected to the back plate 13, the lower end of the back plate 13, the lower end of the bottom plate 14, the lower end of the front side plate 11, and the lower ends of the two side plates 12 are connected to the bottom plate 14; the upper end of the back plate 13, the upper end of the bottom plate 14, the upper end of the front side plate 11, and the upper ends of the two side plates 12 are connected to the top cover 15. The casing 10 structure is easy to manufacture and easy to assemble. The front side surface of the casing 10 is located on the front side plate 11. The back side surface of the casing 10 is located on the back plate 13. The bottom plate 14 constitutes the bottom of the casing 10. The top cover 15 constitutes the top of the casing 10.

Of course, in some embodiments, any three to five structures of the top cover 15, the back plate 13, the bottom plate 14, the front side plate 11, and the two side plates 12 may be integrally formed to ensure the connection strength. Of course, in some embodiments, any two adjacent structures among the top cover 15, the back plate 13, the bottom plate 14, the front side plate 11 and the two side plates 12 may be integrally formed.

In one embodiment, the side plates 12 and the front side plate 11 are integrally formed, which is convenient for assembly and can ensure the connection strength between the side plates 12 and the front side plate 11.

Figure 6:
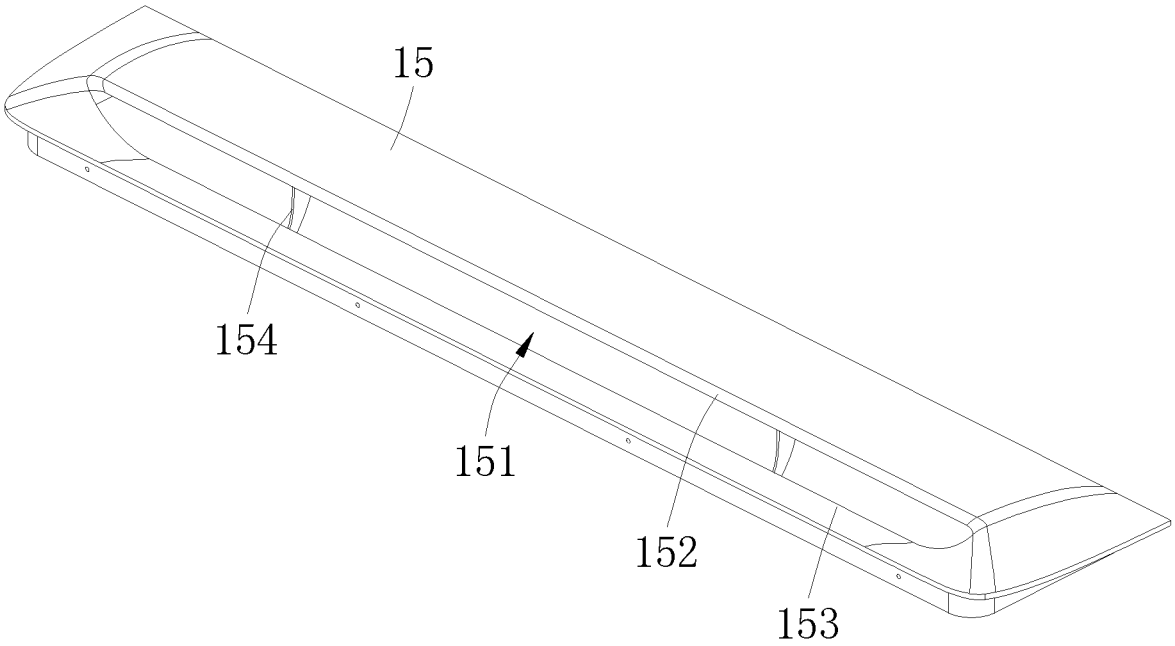
FIG. 6 is a structural schematic view of a top cover in the wall-mounted air purifier shown in FIG. 3.

In an embodiment, please refer to FIG. 6, the air inlet 151 is arranged on the top cover 15 of the casing 10, and the height of one sidewall 152 of the air inlet 151 is greater than the height of another sidewall 153 of the air inlet 151, so that a vertical air inlet 151 can be formed, and during the carrying, the user can insert into the air inlet 151 to lift the top cover 15 using his hand, and then carry the wall-mounted air purifier 100.

In one embodiment, the sidewall 153 of the air inlet 151 adjacent to the front side of the casing 10 extends downward from the front to the back direction, so that the air inlet 151 faces the front side of the casing 10, and the air in front of the casing 10 can enter the casing 10 from the air inlet 151 for purification.

In one embodiment, in the front-to-back direction: the sidewall 152 of the air inlet 151 adjacent to the back side of the casing 10 is in an arch shape with the middle part bent upward to facilitate hand-carrying. Of course, in other embodiments, the sidewall of the air inlet 151 adjacent to the back side of the casing 10 may also be flat.

In one embodiment, the top cover 15 is provided with a reinforcing plate 154 connecting the two opposite sidewalls of the air inlet 151 to increase the structural strength of the top cover 15 corresponding to the position of the air inlet 151.

Figure 7:
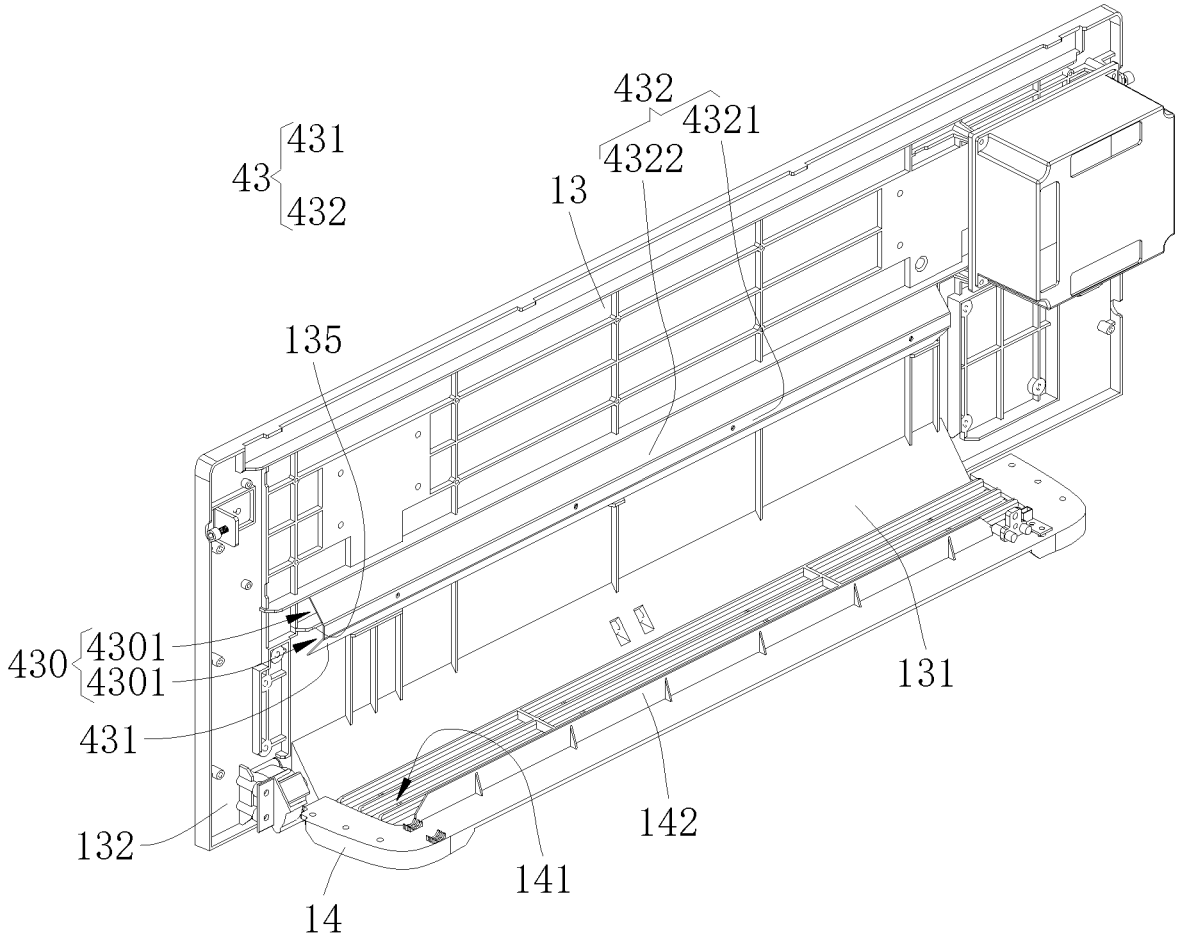
FIG. 7 is a structural schematic view of the wall-mounted air purifier shown in FIG. 3, wherein a back plate, a bottom plate and a cover are combined.
Figure 8:
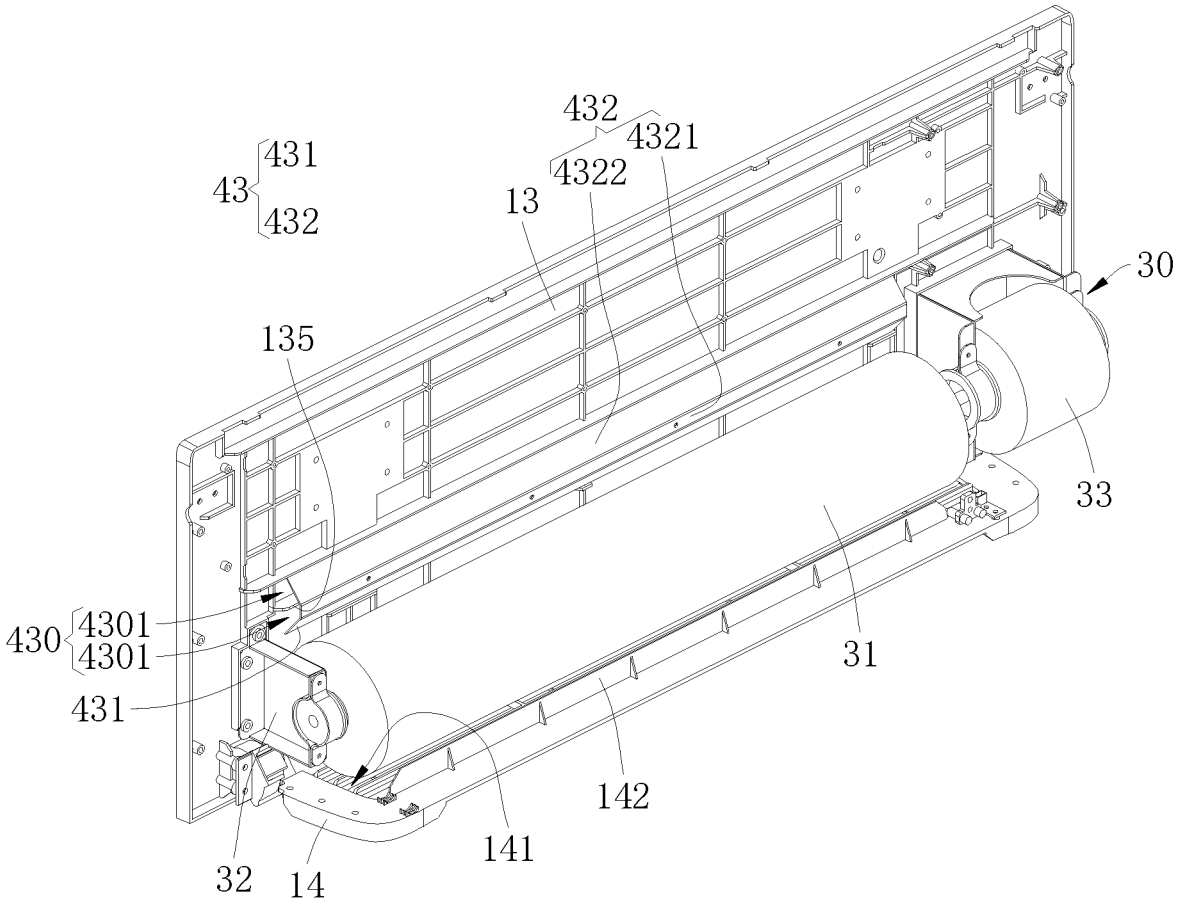
FIG. 8 is a structural schematic view of the wall-mounted air purifier shown in FIG. 3, wherein a back plate, a bottom plate, a cover and a fan are combined.

In one embodiment, referring to FIGS. 2, 7 and 8, a cover 43 is mounted in the casing 10, two sides of the cover 43 are arranged adjacent to the inner surface of the casing 10, and the inner surfaces of the cover 43 and the casing 10 enclose to form a cable channel 430, so that the cables of the wall-mounted air purifier 100 can be arranged in the cable channel 430, and the cables can be protected by the cover 43, and the wiring can be facilitated, the cables can be prevented from being messy, and the assembly and maintenance of the devices in the casing 10 can be facilitated.

In one embodiment, referring to FIGS. 2, 7 and 8, the inner surface of the casing 10 is convexly provided with a partition 135, and the partition 135 extends into the cover 43 to separate the cable channel 430 into at least two sub-channels 4301. If one partition 135 is arranged in the cover 43, the cable channel 430 can be divided into two sub-channels 4301, so that the two sub-channel 4301 can be used for high-voltage cables and low-voltage cables to respectively pass through, avoiding interference between the high-voltage cables and the low-voltage cables, especially to avoid high-voltage breakdown at the high-voltage end, which can generate electromagnetic waves that interfere with the stable output of the low-voltage end, avoid affecting signal reception, thereby avoiding failures of the whole machine, and ensuring the safe operation of the whole machine. Of course, the two sub-channels 4301 can be used for passing through the cable layouts of different devices respectively. When two partitions 135 are spaced apart in the cover 43, the cable channel 430 can be divided into three sub-channels 4301 for different cable layouts to pass through.

In one embodiment, the partition 135 may be a reinforcing rib on the inner surface of the casing 10 to increase the strength of the casing 10. In addition, the cable channel 430 can be divided into at least two sub-channels 4301 by the reinforcing ribs. Of course, in some embodiments, the partition(s) 135 may be separately provided on the inner surface of the casing 10.

In one embodiment, the cover 43 is mounted on the back plate 13 of the casing 10 to facilitate wiring, and when the casing 10 is mounted on the wall, it can also facilitate the layout of the cable to be connected to an external power supply. Of course, in some other embodiments, the cover 43 may be provided on the top cover 15 of the casing 10 to form the cable channel 430 on the top cover 15 of the casing 10. In some other embodiments, the cover 43 may be provided on the front side plate 11 of the casing 10 to form the cable channel 430 on the front side plate 11 of the casing 10. In some other embodiments, the cover 43 may be provided on the bottom plate 14 of the casing 10 to form the cable channel 430 on the bottom plate 14 of the casing 10.

In one embodiment, referring to FIGS. 2, 3 and 8, the air inlet 151 is located at the top of the casing 10, the air outlet 141 is located at the bottom of the casing 10, and the fan 30 includes a cross flow wind wheel 31, a support seat 32 and a motor 33, the support seat 32 supports the cross flow wind wheel 31, and the support seat 32 and the motor 33 are mounted in casing 10. By using of the cross flow wind wheel 31, the occupied space is smaller, the area of air-out is larger, so that the wall-mounted air purifier 100 can be made smaller in size and can supply purified air to a larger area. One side of air outlet 141 is convexly provided with a stop baffle 142, the stop baffle 142 is located on the side of air outlet 141 downstream of the cross flow wind wheel 31, and the stop baffle 142 is used to stop the cross flow wind wheel 31 from flowing back, such that the air flow sent out by the rotation of the cross flow wind wheel 31 will be discharged from the air outlet 141, and the there is no need to separately set up a windshield, thereby the occupied space can be reduced, the weight and the costs can be reduced. Of course, in other embodiments, the fan 30 with a windshield may also be provided in the casing 10. In some other embodiments, a centrifugal fan 30 may be provided in the casing 10.

In one embodiment, referring to FIGS. 2, 3 and 8, the casing 10 is provided with a deflector 431, which is suitable for guiding airflow into the cross flow wind wheel 31, and the deflector 431 extends from the inner surface of the casing 10 away from the stop plate 142 toward the middle of the casing 10 and extends obliquely upwards. By arranging the deflector 431, the air can be better guided into the cross flow wind wheel 31 and cooperated with the stop baffle 142 to guide the cross flow wind wheel 31 to ensure the air outlet efficiency of the cross flow wind wheel 31.

In one embodiment, the deflector 431 is mounted on the back plate 13 of the casing 10, and the stop baffle 142 is located on the side of the air outlet 141 adjacent to the front side of the casing 10, so that the wind from the cross flow wind wheel 31 can better flow toward the front side of the bottom of the casing 10. Of course, in some embodiments, the deflector 431 can also be mounted on the front side plate 11 of the casing 10, and the stop baffle 142 is located on the side of the air outlet 141 adjacent to the back side of the casing 10, so that the wind from the cross flow wind wheel 31 can better flow toward rear side of the bottom of the casing 10.

In one embodiment, the wall-mounted air purifier 100 further includes a bending plate 432 connected to the deflector 431, and the bending plate 432 extends from the upper side of the deflector 431 toward the inner surface of the casing 10 away from the stop baffle 142. By setting the bending plate 432, the deflector 431 can be better supported, and the bending plate 432 can cooperate with the deflector 431 to form the cover 43 mentioned above, so that the inner surfaces of the cover 43 and the casing 10 on the side away from the stop baffle 142 are enclosed to form the cable channel 430 through which the cable layout can pass.

In one embodiment, the bending plate 432 includes a vertical plate 4321 and an upper side plate 4322. The vertical plate 4321 extends upward from the upper side of the deflector 431, and the upper side plate 4322 extends from the upper side of the vertical plate 4321 toward the inner surface of the casing 10 away from the stop baffle 142. By arranging the vertical plate 4321 and upper side plate 4322 can increase the cross-sectional area of the cable channel 430 to facilitate cable layout. In addition, the upper side plate 4322 extends from the upper side of the vertical plate 4321 toward the inner surface of the casing 10 away from the stop baffle 142, which can better guide the air flowing out of the purification module 20 into the cross flow wind wheel 31 to reduce air flow resistance.

In one embodiment, referring to FIGS. 2, 3 and 8, the stop baffle 142 is located on the side of the air outlet 141 adjacent to the front side of the casing 10, and the lower end of the back plate 13 of the casing 10 is provided with an inclined plate 131, the inclined plate 131 extends from the lower end of the back plate 13 downward and forward obliquely, and the inclined plate 131 is located at the lower side of the central axis of the cross flow wind wheel 31, so that the air can be drawn through the inclined plate 131, and the air can better flow out of the air outlet 141 to improve the wind efficiency.

In one embodiment, the inclined plate 131 is located in the middle of the lower end of the back plate 13, the lower end of the back plate 13 at two ends of the inclined plate 131 respectively extend downward with an extending plate 132, and two ends of the inclined plate 131 respectively extend backward with a support plate 133. The support plates 133 are connected with the corresponding extending plates 132 to avoid wind exposure at two ends of the inclined plate 131, so as to improve the air outlet efficiency of the air outlet 141.

Figure 9:
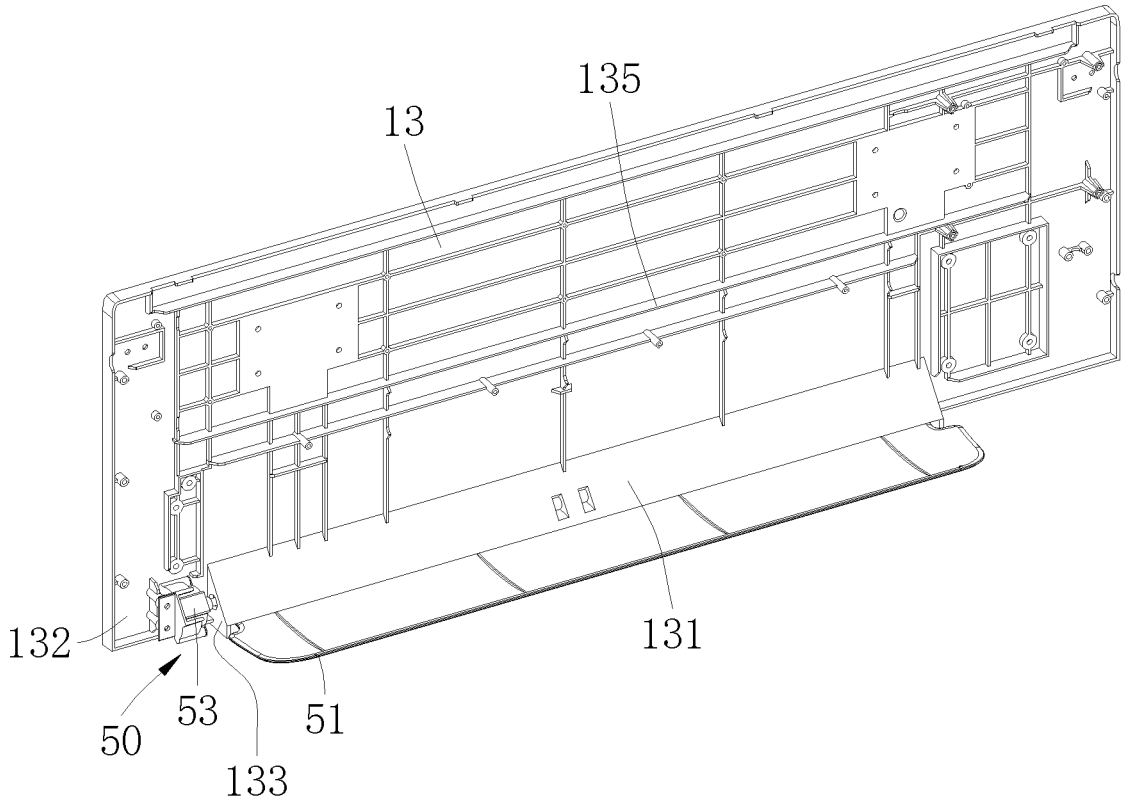
FIG. 9 is a structural schematic view of the wall-mounted air purifier shown in FIG. 3, wherein a back plate and a wind guide assembly are combined.
Figure 10:
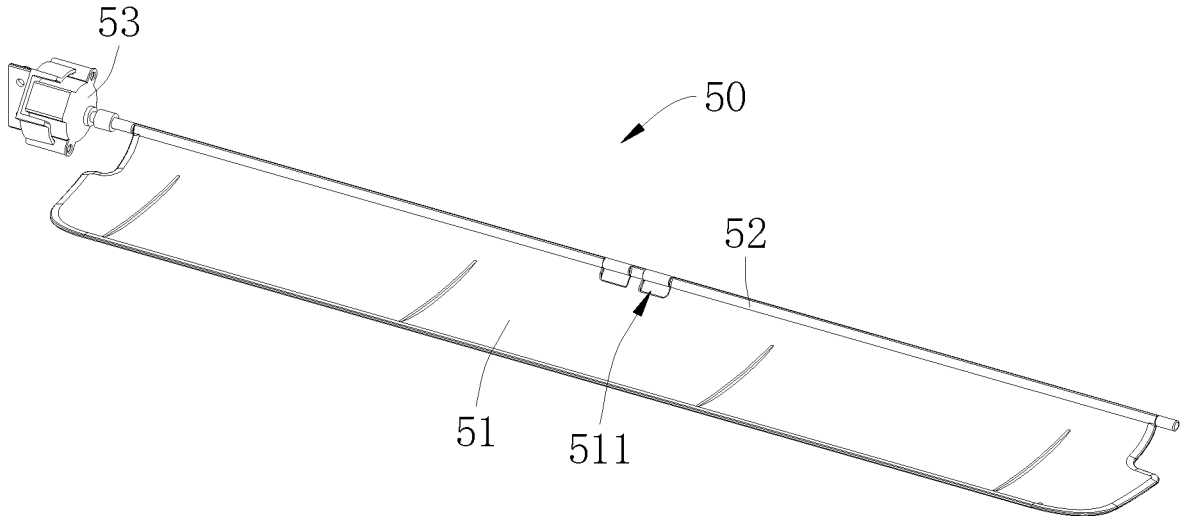
FIG. 10 is a structural schematic view of the wind guide assembly shown in FIG. 9.

In one embodiment, referring to FIGS. 2, 9 and 10, the wall-mounted air purifier 100 further includes a wind guide assembly 50, and the wind guide assembly 50 is used to guide the wind. The wind guide assembly 50 includes a wind guide piece 51 and a motor 53, the wind guide piece 51 is rotatably mounted at the bottom of the casing 10, the motor 53 is mounted in the casing 10, the wind guide piece 51 is driven to swing by the motor 53, and the wind guide piece 51 can be covered on the air outlet 141, to close the air outlet 141 to prevent impurities from entering the casing 10. When the wind guide piece 51 rotates, the air outlet 141 can also be opened to guide the air flow from the air outlet 141 to flow downward and forward, thereby guiding the wind out.

In one embodiment, the rear side of the wind guide piece 51 is provided with a rotating shaft 52, the rotating shaft 52 is connected to the motor 53, and the rotating shaft 52 is rotatably mounted on the casing 10. This structure can prevent airflow from flowing out from the rear side of the wind guide piece 51, and can better guide the airflow to the front side below the casing 10.

Figure 11:
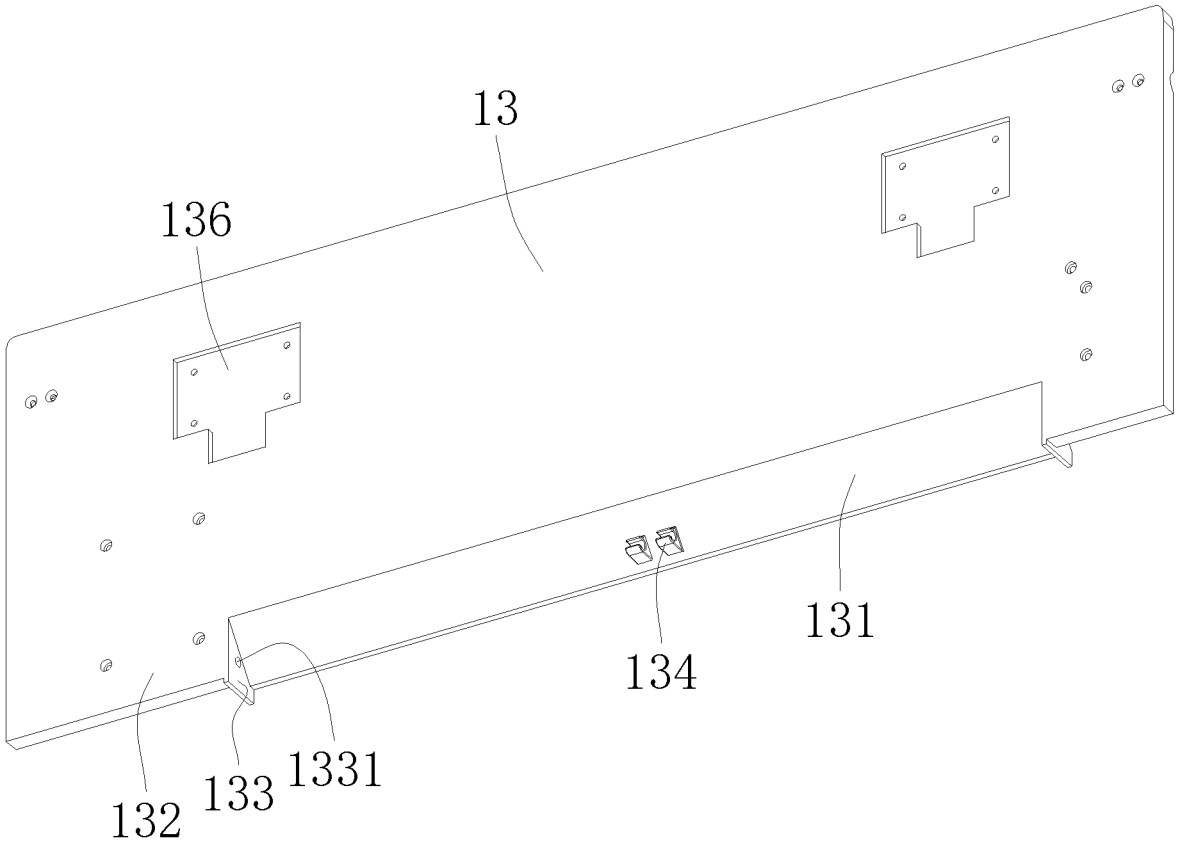
FIG. 11 is a schematic perspective view of the back plate shown in FIG. 9 in a rear view direction.
Figure 12:
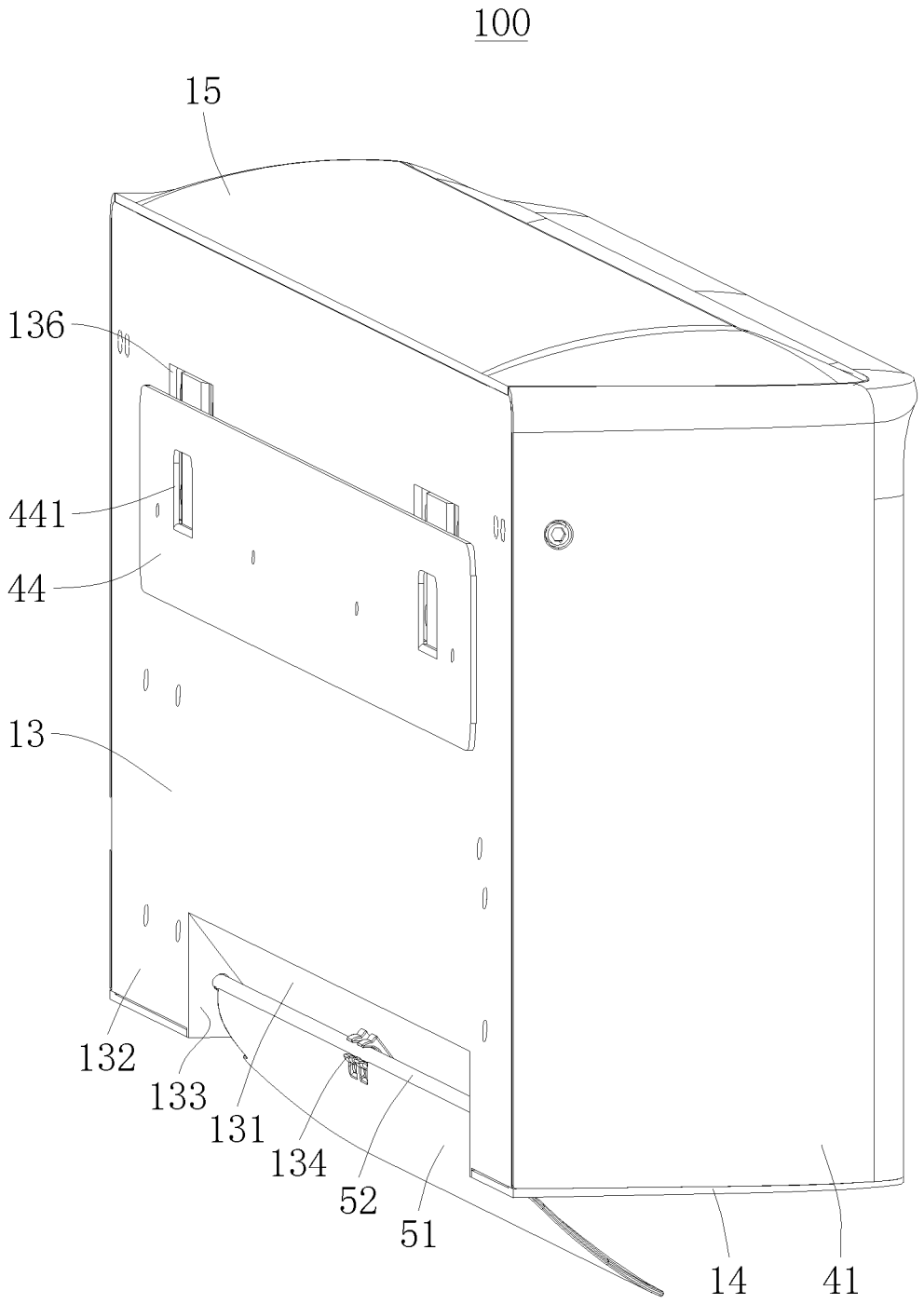
FIG. 12 is a schematic perspective view of a wall-mounted air purifier provided by an embodiment of the present application in a rear view direction.

In one embodiment, referring to FIGS. 10 to 12, the bottom of the back side of the casing 10 is provided with a hook 134, the rotating shaft 52 is hung on the hook 134, and the rear side of the wind guide piece 51 is provided with a through opening 511, and when the rotating shaft 52 is connected to the hook 134, the hook 134 passes through the through opening 511. By arranging the hook 134, the rotating shaft 52 can be supported better, and then the wind guide piece 51 is supported. When the casing 10 includes the back plate 13, the hook 134 is provided on the back plate 13.

In one embodiment, when the aforementioned inclined plate 131 is provided on the back plate 13 of the casing 10, the hook 134 is provided on the outer surface of the inclined plate 131 to better support the rotating shaft 52 and reduce the occupation the rotating shaft 52 to the internal space of casing 10.

In one embodiment, when the above-mentioned support plates 133 is provided on the back plate 13 of the casing 10, each support plate 133 is provided with a through hole 1331, and the end of the rotating shaft 52 passes through the corresponding through hole 1331 to rotate and support the rotating shaft 52, in turn, supports the wind guide piece 51.

In one embodiment, referring to FIGS. 11 and 12, a hanging buckle 136 is provided on the rear side of the casing 10, so that the casing 10 can be mounted on the wall by means of hooking, which is convenient for installation and fixation. Of course, in some other embodiments, the casing 10 can also be mounted on the wall using screws.

In one embodiment, the wall-mounted air purifier 100 further includes a hanging plate 44. The hanging plate 44 is provided with a hook body 441 that cooperates with the hanging buckle 136, and the hanging plate 44 is used for fixing to a wall. By arranging of the hanging plate 44, the user can fix the hanging plate 44 on the wall first, and then hang the casing 10 on the hanging plate 44, which is convenient for positioning and installation. The hanging plate 44 can be pasted on the wall or fixed on the wall by nails.

Figure 13:
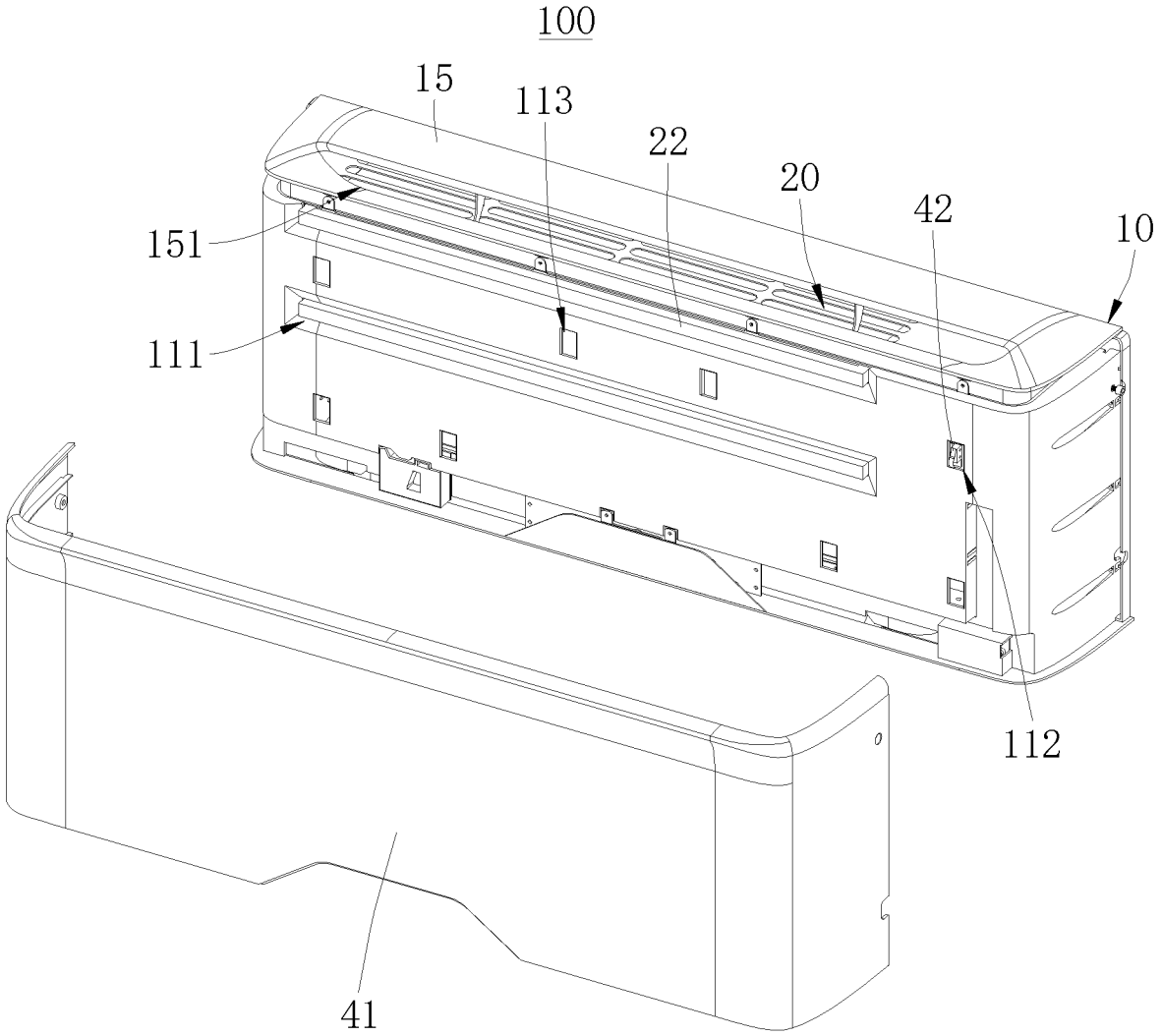
FIG. 13 is a first schematic perspective view of a wall-mounted air purifier provided by an embodiment of the present application, wherein a front cover is separated from a casing.

In one embodiment, referring to FIGS. 2, 3 and 13, an insertion hole 111 is provided on the front side of the casing 10, and the insertion hole 111 is suitable for inserting the filter 22 into the bracket 21, and the insertion hole 111 is located at the purification module 20 corresponding to the position of the filter 22, that is the filter 22 in the bracket 21 can be pulled out through the insertion hole 111, or the filter 22 can be inserted into the bracket 21 through the insertion hole 111 to facilitate the replacement of the filter 22.

In one embodiment, referring to FIGS. 2, 3 and 13, the wall-mounted air purifier 100 further includes a front cover 41, the front cover 41 is mounted on the casing 10, and the front cover 41 is covered on the front side of the casing 10, to ensure the good appearance of the casing 10 and enhance the user's sensory experience.

Figure 14:
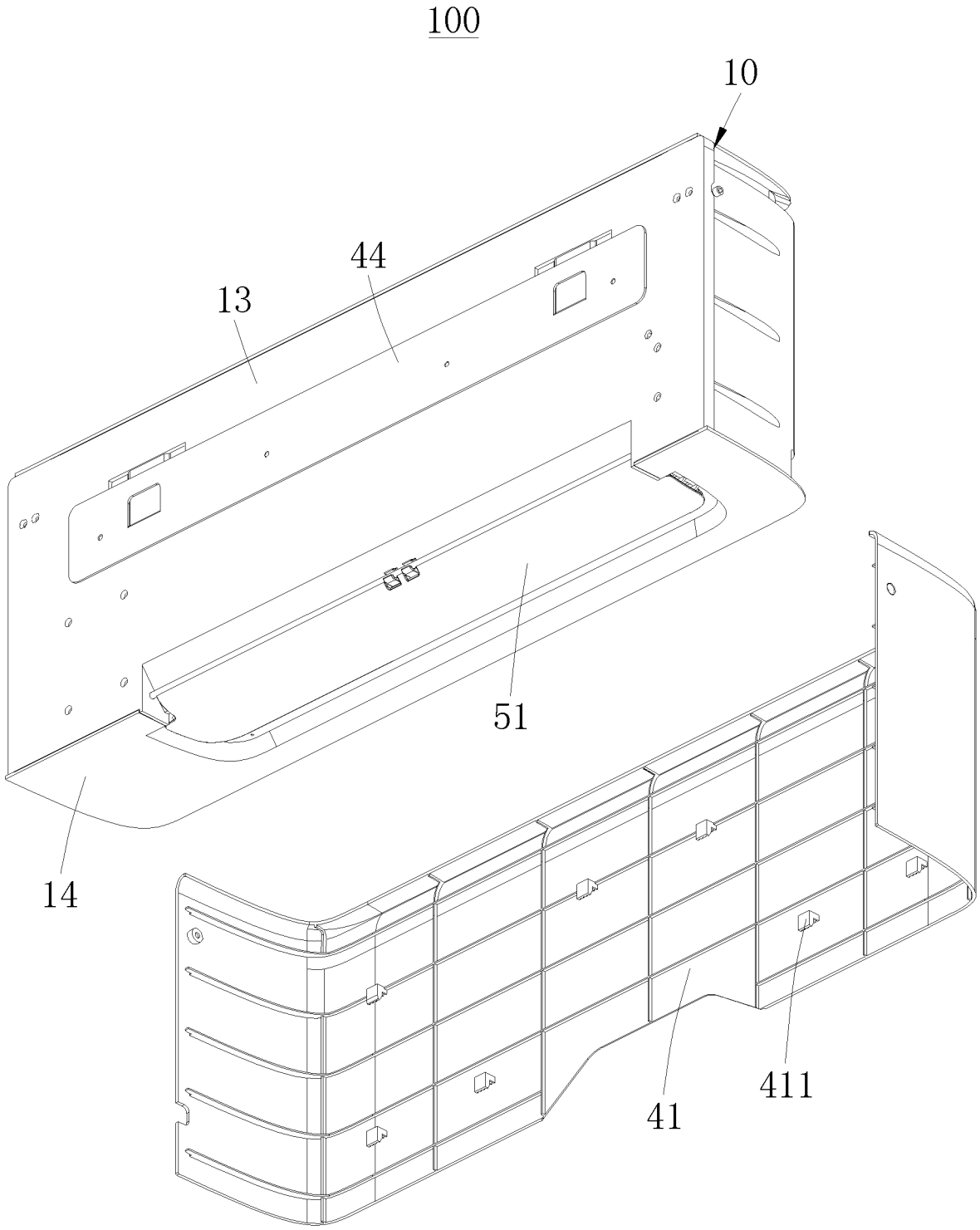
FIG. 14 is a second schematic perspective view of a wall-mounted air purifier provided by an embodiment of the present application, wherein a front cover is separated from a casing In the drawings, the main references are listed.

In an embodiment, please refer to FIGS. 3, 13 and 14, the front cover 41 can be detachably mounted on the casing 10, so that the front cover 41 can be easily removed to replace the filter 22, and realize the balance of the appearance of the wall-mounted air purifier 100 and the convenient replacement of the filter 22.

In one embodiment, referring to FIGS. 3, 13 and 14, a sensor 42 is mounted on the casing 10, and the sensor 42 is used to sense the front cover 41 to determine whether the front cover 41 is mounted on the casing 10 to ensure that the wall-mounted air purifier 100 can be operated more safely. In one embodiment, the sensor 42 may be a micro switch, when the front cover 41 is mounted on the casing 10, the front cover 41 contacts the micro switch to activate the micro switch to sense whether the front cover 41 is mounted on the casing 10. Of course, in other embodiments, the sensor 42 may also be a photodetector or the like.

In one embodiment, the sensor 42 is mounted inside the casing 10, and the casing 10 is provided with an opening 112 exposing the sensor 42. By mounting the sensor 42 inside the casing 10 to better protect the sensor 42.

In one embodiment, referring to FIGS. 3, 13 and 14, a number of engagement openings 113 are provided on the casing 10, and a number of hanging hooks 411 are correspondingly provided on the front cover 41. When the front cover 41 is mounted on the casing 10, the hanging hooks 411 are hung in the corresponding engagement openings 113 to support the front cover 41 on the casing 10, which is convenient for installation and also facilitates the removal of the front cover 41 from the casing 10. Of course, in other embodiments, the front cover 41 can also be detachably mounted on the casing 10 in other ways, such as being fixed on the casing 10 by magnetic attraction.

In one embodiment, the front cover 41 is U-shaped, and the front cover 41 covers the front side and the left and right sides of the casing 10. This structure can make the wall-mounted air purifier 100 look more integrated and improve the user's sensory experience. Of course, in other embodiments, the front cover 41 may also be only covered on the front side of the casing 10.

In the wall-mounted air purifier 100 of the embodiment of the present application, by arranging the bracket 21 in the casing 10, and the filter 22 is inserted on the bracket 21, and the insertion hole 111 is provided on the front side of the casing 10, the removing and replacement of the filter 22 can be realized, and the filter 22 is easy to replace; in addition, the front cover 41 is detachably covered at the front side of the casing 10 to protect the filter 22 and enhance the appearance of the casing 10, so as to balance the appearance of the wall-mounted air purifier 100 and the convenient replacement of the filter 22.

In the wall-mounted air purifier 100 of the embodiment of the present application, by arranging the cover 43 in the casing 10, the cable channel 430 is enclosed between the inner surface of the cover 43 and the inner surface of the casing 10, so as to facilitate the layout of cables and facilitate the assembly and maintenance of the components in the casing 10, and can protect the cables.

In the wall-mounted air purifier 100 of the embodiment of the present application, the stop baffle 142 is provided on the side downstream of the cross flow wind wheel 31 from the air outlet 141, so as to block the cross flow wind wheel 31 from flowing back; then the air flow sent out by the rotation of the cross flow wind wheel 31 will be discharged from the air outlet 141, thereby there is no need to set up a separate windshield, which can reduce the occupied space, reduce weight and reduce cost.

The aforementioned embodiments are only optional embodiments of the present application, and should not be regarded as being limitation to the present application. Any modification, equivalent replacement, improvement, and so on, which are made within the spirit and the principle of the present application, should be included in the protection scope of the present application.

What is claimed is:

1. A wall-mounted air purifier, comprising;

a casing, provided with an air inlet and an air outlet;

a fan, mounted in the casing and located between the air inlet and the air outlet; and a purification module, mounted in the casing and arranged at an air flow path of the fan;

wherein the purification module comprises a bracket mounted in the casing and a filter inserted in the bracket, a front side surface of the casing is provided with a insertion hole configured for inserting the filter into the bracket, the insertion hole is located at a position corresponding to the filter, the wall-mounted air purifier further comprises a front cover covering at a front side of the casing, and the front cover is detachably connected to the casing;

wherein the bracket comprises two support plates respectively arranged at two sides of the filter, and each of the two support plates is provided with a slot configured for an end portion of the filter inserting therein;

wherein the purification module further comprises an ultraviolet light source disposed between the two support plates; and wherein the bracket further comprises an enclosing plate cooperated with the two support plates to form a box structure, and the enclosing plate being arranged around the ultraviolet light source, wherein a side of the enclosing plate adjacent to the air inlet is provided with an air inlet hole, and a side of the enclosing plate adjacent to the fan is provided with an air outlet hole.

2. The wall-mounted air purifier of claim 1, wherein the casing is mounted with a sensor configured for sensing the front cover.

3. The wall-mounted air purifier of claim 2, wherein the sensor is mounted inside the casing, and the casing is provided with an opening configured for exposing the sensor.

4. The wall-mounted air purifier of claim 1, wherein a side of the enclosing plate adjacent to the air inlet hole is provided with the filter, and/or a side of the enclosing plate adjacent to the air outlet hole is provided with the filter.

5. The wall-mounted air purifier of claim 1, wherein the purification module further comprises a detector for sensing the filter, and the detector being mounted on the bracket.

6. The wall-mounted air purifier of claim 1, wherein the casing comprises a top cover provided with the air inlet, and a height of a sidewall of the air inlet is greater than a height of another sidewall of the air inlet.

7. The wall-mounted air purifier of claim 6, wherein a sidewall of the air inlet adjacent to a front side of the casing extends downwardly from a front to back direction.

8. The wall-mounted air purifier of claim 2, wherein the purification module further comprises a detector for sensing the filter, and the detector being mounted on the bracket.

9. The wall-mounted air purifier of claim 3, wherein the purification module further comprises a detector for sensing the filter, and the detector being mounted on the bracket.

10. The wall-mounted air purifier of claim 2, wherein the casing comprises a top cover provided with the air inlet, and a height of a sidewall of the air inlet is greater than a height of another sidewall of the air inlet.

11. The wall-mounted air purifier of claim 3, wherein the casing comprises a top cover provided with the air inlet, and a height of a sidewall of the air inlet is greater than a height of another sidewall of the air inlet.

12. The wall-mounted air purifier of claim 10, wherein a sidewall of the air inlet adjacent to a front side of the casing extends downwardly from a front to back direction.

13. The wall-mounted air purifier of claim 11, wherein a sidewall of the air inlet adjacent to a front side of the casing extends downwardly from a front to back direction.

* * * * *